United States Patent [19]

Coontz

[11] Patent Number: 4,976,388

[45] Date of Patent: Dec. 11, 1990

[54] SHOULDER STRAP ASSEMBLY HAVING LIMITED STRETCHABILITY

[76] Inventor: James D. Coontz, 3832 E. Acorn, Simi Valley, Calif. 93063

[21] Appl. No.: 472,242

[22] Filed: Jan. 30, 1990

[51] Int. Cl.[5] ..... A41F 15/02

[52] U.S. Cl. ..... 224/264; 224/257

[58] Field of Search ..... 224/264, 257, 258, 202, 224/205, 207, 150; 150/110, 107, 108

[56] References Cited

U.S. PATENT DOCUMENTS

| | | | |
|---|---|---|---|
| 2,830,747 | 4/1958 | Creste | 224/913 |
| 3,882,914 | 5/1975 | Strutz | 224/202 |
| 4,096,863 | 6/1978 | Kaplan et al. | 224/901 |
| 4,361,258 | 11/1982 | Clark | 224/150 |
| 4,401,246 | 8/1983 | Dickinson et al. | 224/264 |
| 4,550,869 | 11/1985 | Johnson | 224/264 |
| 4,569,465 | 2/1986 | O'Farrell | 224/229 |
| 4,716,892 | 1/1988 | Brunswick | 128/77 |
| 4,768,689 | 9/1988 | Davis | 224/150 |
| 4,782,556 | 11/1988 | Kim | 150/110 |
| 4,827,578 | 5/1989 | Heckerman et al. | 224/257 |

*Primary Examiner*—Linda J. Sholl
*Attorney, Agent, or Firm*—Gene W. Arant

[57] ABSTRACT

A shoulder strap assembly combines both stretchable and non-stretchable strap members in such a way that the complete assembly has a carefully restricted ability to stretch in the longitudinal direction. A bottom one of the strap members is totally resilient and provides excellent cushioning but lacks the necessary stiffness and mechanical strength to support a load. An upper strap member has a composite structure, being of non-stretchable and strong material in its two end portions but stretchable in its middle section. These two strap members are combined in a parallel relationship and fastened together at the two ends of the stretchable middle section, as well as at other points along their length. The significance of the invention is that while it provides comfort for the wearer and a solid support of whatever load the wearer is carrying, a limited longitudinal stretchability of the strap assembly greatly minimizes the bouncing action.

6 Claims, 2 Drawing Sheets

SHOULDER STRAP ASSEMBLY HAVING LIMITED STRETCHABILITY

FIELD OF THE INVENTION

There are almost an unlimited number of situations where a person finds it convenient or necessary to utilize a shoulder strap for carrying a load. In modern context, one example is a golfer who carries a golf bag for large distances while walking around a golf course.

For convenience of the wearer, such a strap assembly is often made adjustable. Furthermore, whatever the load may be, it is desirable to construct the strap assembly in such a way as to provide a cushioning action upon the shoulder of the wearer.

PRIOR ART

Applicable prior art discovered by Applicant from a novelty search includes:

| U.S. Pat. No. | Inventor | Intl. Class. |
|---|---|---|
| 4,550,869 | Johnson | A61F 5/40 |
| 4,361,258 | Clark | F41C 33/00 |
| 4,401,246 | Dickenson & Clark | G41D 11/00 |
| 4,096,863 | Kaplan et al | A61M 25/02 |
| 4,569,465 | O'Farrell | A45F 3/00 |
| 4,716,892 | Brunswick | A61F 5/04, 5/02 |
| 4,782,556 | Kim | A45C 13/26 |
| 4,768,689 | Davis | A45F 3/14 |
| 2,830,747 | Creste | Cl. 224-I (old U.S.) |

A number of the references show adjustable straps. Johnson and Davis show flexible straps. Johnson's strap assembly includes cushioning material which is elastically deformable under load.

BACKGROUND OF THE INVENTION

A particular problem which has been encountered is that the up-and-down motion which a person experiences when walking can translate into uncomfortable changes in the load pressure of the strap assembly upon the person's shoulder. Also, when cushioning material is used that is resilient and hence stretchable, the up-and-down walking motion causes the load to bounce up and down in an undesirable fashion.

Furthermore, the weight of the load being carried has an influence on the bouncing effect. Particularly if a heavy load is being carried, a strap assembly which has a sufficient amount of resilience to provide a desired cushioning effect may at the same time permit excessive bouncing, which is very uncomfortable and inconvenient for the person involved.

SUMMARY OF THE INVENTION

According to the invention a shoulder strap assembly combines both stretchable and non-stretchable strap members in such a way that the complete assembly has a carefully restricted ability to stretch in the longitudinal direction. The significance of the invention is that it provides comfort for the wearer and a solid support of whatever load the wearer is carrying, and that a limited longitudinal stretchability of the strap assembly greatly minimizes the bouncing action.

More particularly, in the presently preferred form of the invention an elongated resilient under strap member provides a shoulder pad having an under surface adapted to cushionably rest upon the shoulder of a wearer. An auxiliary strap assembly is disposed above and in parallel relation to the shoulder pad. The auxiliary strap assembly includes first and second separate end sections made of a relatively non-stretchable material, and also a separate center section made of a material which is longitudinally stretchable. First and second transverse stitch means secure the corresponding ends of the stretchable center section, as well as the inner ends of the first and second end sections of the auxiliary strap assembly, to the shoulder pad. The ends of the auxiliary strap assembly are secured to respective ends of the shoulder pad. As a result, the complete strap assembly is divided into at least a middle portion and two end portions, so that the weight of a load carried from the ends of the strap assembly may cause it to stretch by a substantial amount in its middle portion, between the first and second stitch means, but not within its end portions.

An additional feature of the preferred form of the invention is a cover strap member which not only provides an improved appearance of the assembly, but also aids in its mechanical functioning.

DRAWING SUMMARY

DETAILED DESCRIPTION

A complete strap assembly A includes an elongated, relatively wide and relatively thick shoulder pad or bottom strap member 15 which is made of an elastomeric material such as neoprene. This shoulder pad fits directly upon the person's shoulder and provides cushioning action. The bottom strap member or shoulder pad 15 is preferably widened in its middle portion relative to its ends, as shown.

Figure 1:
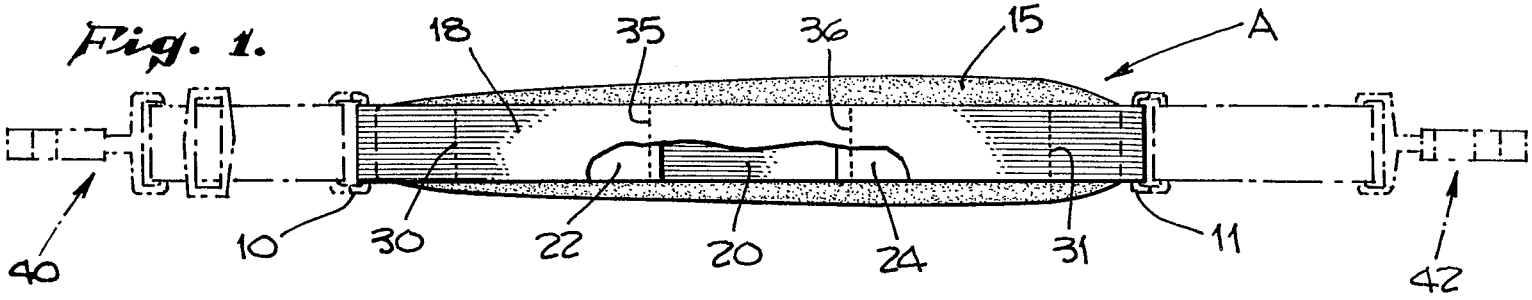
FIG. 1 is a top plan view of the strap assembly when it is laid out full length upon a flat surface.
Figure 2:
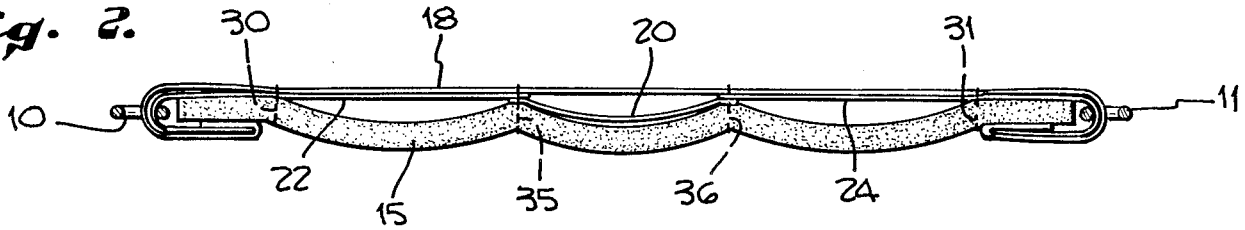
FIG. 2 is a side elevation view of the strap assembly on a slightly enlarged scale, but not including the snap fasteners at the two ends of the assembly.
Figure 3:
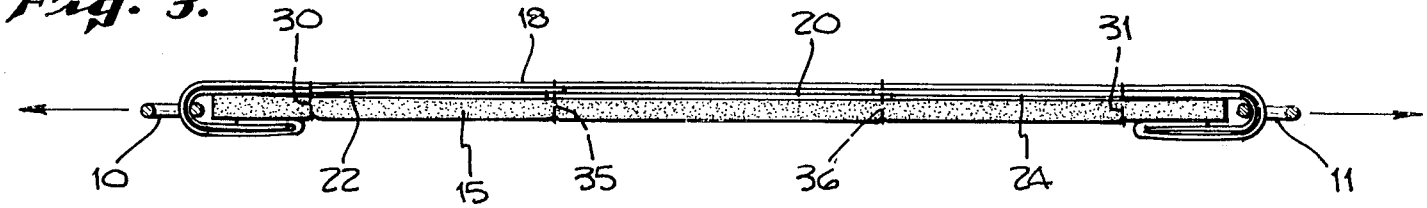
FIG. 3 is a side elevation view like FIG. 2, but showing the strap assembly in a longitudinally stretched condition.

FIG. 3 shows the strap assembly of the invention in its stretched condition, while FIGS. 1, 2, and 4–6 show the strap assembly when it not stretched. In FIG. 2 the strap member 15 at the bottom of the assembly is shown with an exaggerated amount of sag, but only for purpose of clarity in illustration.

The complete shoulder strap assemblY also comprises an auxiliary strap assembly disposed above and in parallel relation to the shoulder pad 15. This auxiliary strap assembly includes a center section 20 made of a material that is longitudinally stretchable, and first and second end sections 22, 24, which are made of a relatively non-stretchable material. The separate short piece 20 of stretchable strap material covers a middle longitudinal portion of pad 15. The pair of truncated, non-stretchable strap members 22, 24, are disposed upon the upper surface of the under strap member 15 and cover respective end portions thereof. The outer ends of the non-stretchable strap members also extend beyond the respective ends of the under strap member 15. The inner ends of straps 22, 24, are in overlapping relation to the respective ends of center strap section 20. See FIG. 6.

An elongated and longitudinally stretchable cover strap member 18 is disposed in parallel relation above, and covering, both the center strap member 20 and each of the non-stretchable strap members 22, 24. The cover strap is not indispensable to the operation of the device, but provides an improved appearance as well as assisting in the mechanical function.

There are first and second transverse stitch strips 35, 36, which fasten respective ends of center stretch piece 20 to the overlapping ends of respective non-stretch pieces 22, 24, as well as to corresponding points on the shoulder pad 15 and the cover strap 18. Third and fourth transverse stitch strips 30, 31 are also provided at locations somewhat inwardly from the respective ends of strap member 15. These third and fourth stitch strips secure the under strap member 15, near its respective ends, to the respective non-stretchable strap members 22, 24, near their corresponding ends, and at the same time to the cover strap member 18. See FIG. 5. The stitch strips 30, 31, do not extend the full width of the elastomeric pad 15, as may be clearly seen in FIG. 4.

A separate load-attachment means is secured to each respective end of the cover strap member 18 and also to its associated non-stretchable strap member 22 or 24. As shown, a belt loop 10 on the left-hand end of assembly A receives a conventional snap-fastener 40, while a belt loop 11 on the right-hand end of assembly A receives a conventional snap-fastener 42.

Although not specifically shown, it will be understood that the snap fasteners 40, 42, are utilized for attachment to a load, which is then carried by the person through use of the strap assembly.

Figure 5:
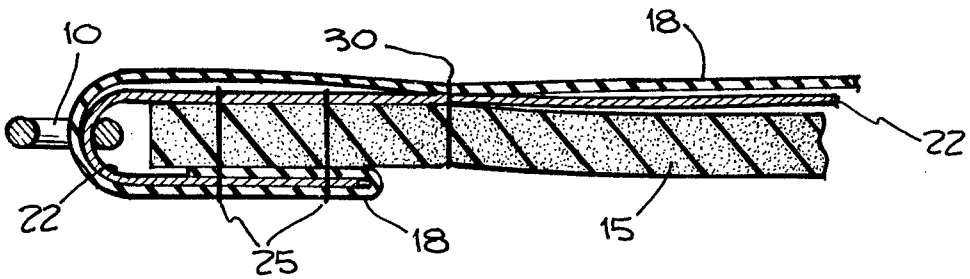
FIG. 5 is a fragmentary cross-sectional view taken on line 5—5 of FIG. 4.
Figure 6:
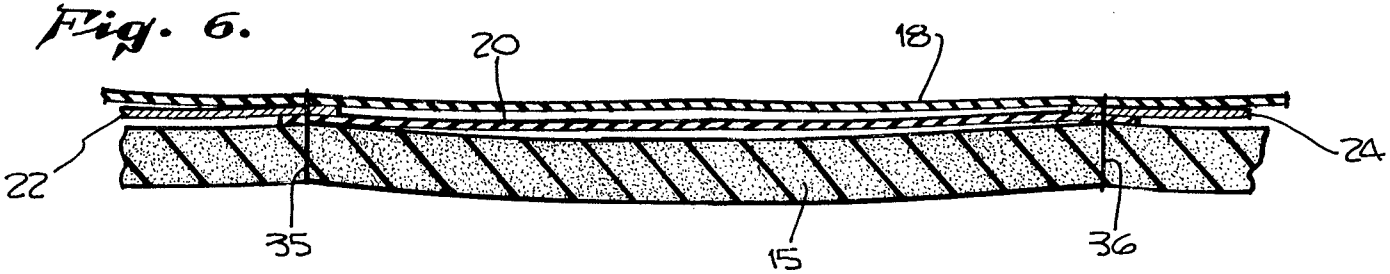
FIG. 6 is a fragmentary cross-sectional view taken on line 6—6 of FIG. 4.

More specifically, the extending ends of the non-stretchable strap members 22, 24, and of the cover strap member 18 are turned over the respective ends of the shoulder pad 15 in 180 degree bends, as shown in FIG. 5. The belt loops 10 and 11 are secured within respective ones of the turned-over strap members. It will also be seen as shown in FIG. 5 that beneath the strap member 15 the extremity of the cover strap 18 is turned over the end of the non-stretchable strap member 22 so as to enclose both its inner and outer surfaces.

Figure 4:
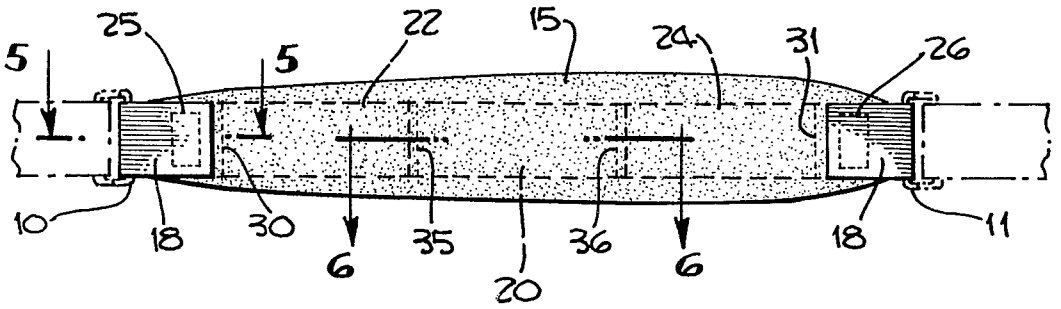
FIG. 4 is a bottom view of the assembly of FIGS. 1 and 2.

The turned-over end portions of the strap members 22, 24, are then sewed upon themselves by fifth and sixth stitch means 25, 26, respectively, which do not pass through the upwardly exposed portion of the cover strap 18, as that would be esthetically undesirable. Thus as shown in FIGS. 4 and 5 with regard to strap member 22, the stitch 25, which forms an enclosed rectangular pattern, passes through the outer portion of cover strap 18 on the bottom side of the strap member 15, then through the extremity of non-stretchable strap section 22, then through the turned-over end portion of cover strap 18, then through the resilient shoulder pad 15, and then again through strap section 22 on the top side of strap member 15. The upper surface of the stitch 25 on the upper portion of strap 22 is then covered by the upwardly facing portion of cover strap 18.

In that connection it should be noted that the non-stretchable strap members 22, 24 are essentially cloth, such as polypropylene or nylon webbing, and their turned-over end portions, having the extremities of the neoprene pad 15 captured within them, are therefore able to provide adequate mechanical support for the snap fasteners, which the neoprene alone could not do. Furthermore, strap members 22, 24, prevent the elastic member 18 from being stretched out of shape by the pulling force of belt loops 10, 11.

In operation, only the coincidence of the stretch straps 18 and 20 in a short center section of the strap assembly permits it to stretch longitudinally. FIG. 3 shows the strap assembly under longitudinal tension, with the center section being stretched by a substantial amount, but the end sections being stretched only slightly. It is this limited stretchability which in turn permits only a limited bouncing action of the load to occur.

It will be understood that the length of the stretch straps 18 and 20 may be made either longer or shorter, as needed, in order to provide the exact mechanical action that is desired. Thus, the stitches 35, 36, may be moved either closer together or further apart, and center strap section 20 made accordingly shorter or longer. Further, it is possible to use only a single stretch strap 20, or for that matter, to use three or more stretch straps in parallel at that location when heavier loads are to be carried.

The invention has been disclosed in considerable detail in its presently preferred form in order to comply fully with the requirements of the patent law. It will be understood, however, that the scope of the invention is to be limited only in accordance with the appended claims.

I claim:

1. A shoulder strap assembly having a limited amount of stretchability, comprising, in combination:

elongated resilient strap means having an under surface adapted to cushionably rest upon the shoulder of a wearer, and being adapted to support a load between its two ends;

auxiliary strap means disposed above and in parallel relation to said elongated resilient strap means, said auxiliary strap means including first and second separate end sections made of a relatively non-stretchable material, and also including a separate center section made of material which is longitudinally stretchable;

first and second transverse stitch means securing the inner ends of said first and second end sections of said auxiliary strap means both to the corresponding ends of said stretchable center section thereof, and to said elongated resilient strap means;

means securing the ends of said auxiliary strap means to respective ends of said elongated resilient strap means; and separate load-attachment means secured to respective ends of said auxiliary strap means;

said strap assembly being responsive to the weight of a load such that the middle portion of said strap assembly between said first and second stitch means may stretch by a substantial amount, but said non-stretchable end sections of said auxiliary stráp means prevent any substantial stretching of the end portions of said strap assembly.

2. The shoulder strap assembly of claim 1 wherein said elongated resilient strap means is substantially thicker than said auxiliary strap means, and has its middle portion widened relative to its ends.

3. The shoulder strap assembly of claim 1 which further includes a cover strap disposed above said auxiliary strap means, said cover strap being made of a longitudinally stretchable material, being secured to said elongated resilient strap means by said first and second stitch means, and being also secured to the respective ends of said elongated resilient strap means.

4. A shoulder strap assembly having a limited amount of stretchability, comprising, in combination:

elongated resilient strap means having an under surface adapted to cushionably rest upon the shoulder of a wearer, and being adapted to support a load between its two ends, said elongated resilient strap means being widened in its middle portion relative to its ends;

auxiliary strap means disposed above and in parallel relation to said elongated resilient strap means, said auxiliary strap means including first and second separate end sections made of a relatively non-stretchable material, and also including a separate center section made of material which is longitudinally stretchable;

a cover strap disposed above and in parallel relation to said auxiliary strap means and being substantially coextensive therewith;

means securing the ends of both said cover strap and said auxiliary strap means to the respective ends of said elongated resilient strap means;

separate load-attachment means secured to respective ends of said auxiliary strap means and said cover strap; and first and second transverse stitch means securing the inner ends of said first and second end sections of said auxiliary strap means both to the corresponding ends of said stretchable center section thereof and to corresponding points on both said elongated resilient strap means and said cover strap.

5. A shoulder strap assembly having a limited amount of stretchability, comprising, in combination:

an elongated resilient under strap member adapted to cushionably rest upon the shoulder of a wearer;

a stretchable center strap member disposed upon the upper surface of said under strap member and covering a middle longitudinal portion thereof;

a pair of truncated, non-stretchable strap members disposed upon the upper surface of said under strap member and covering respective end portions thereof, the outer ends of said non-stretchable strap members extending beyond the respective ends of said under strap member, and the inner end of each of said non-stretchable strap members being in overlapping relation to a corresponding end of said stretchable center strap member;

an elongated and longitudinally stretchable cover strap member disposed in parallel relation above, and covering, both said center strap member and each of said non-stretchable strap members;

first and second stitch means securing respective ends of said center strap member both to the overlapping ends of said non-stretchable strap members and to corresponding points on both said under strap member and said cover strap member;

third and fourth stitch means securing respective ends of said under strap member to both said non-stretchable strap members and said cover strap member; and a separate load-attachment means secured to each respective end of said cover strap member and also to its associated non-stretchable strap member.

6. The strap assembly of claim 5 wherein the extending ends of said non-stretchable strap members and of said cover strap member are turned over the respective ends of said under strap member in 180 degree bends, said load-attachment means are belt loops which are secured within said turned-over strap members, and which further includes fifth and sixth stitch means securing the respective extremities of said cover strap member and non-stretchable members to said under strap member and to the opposite portion of the associated non-stretchable strap member.

* * * * *